US007679583B2

(12) United States Patent
Chung et al.

(10) Patent No.: US 7,679,583 B2
(45) Date of Patent: Mar. 16, 2010

(54) PLASMA DISPLAY AND DRIVING METHOD THEREOF

(75) Inventors: Woo-Joon Chung, Suwon-si (KR); Jin-Sung Kim, Suwon-si (KR); Jin-Ho Yang, Suwon-si (KR); Seung-Hun Chae, Suwon-si (KR); Tae-Seong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 1253 days.

(21) Appl. No.: 11/200,355

(22) Filed: Aug. 10, 2005

(65) Prior Publication Data

US 2006/0033688 A1 Feb. 16, 2006

(30) Foreign Application Priority Data

Aug. 13, 2004 (KR) ..... 10-2004-0063818
Aug. 13, 2004 (KR) ..... 10-2004-0063819
Aug. 13, 2004 (KR) ..... 10-2004-0063820

(51) Int. Cl.
*G09G 3/26* (2006.01)

(52) U.S. Cl. ..... 345/63; 345/690

(58) Field of Classification Search ..... 345/63, 345/60, 61, 204, 211, 67, 690, 316
See application file for complete search history.

(56) References Cited

U.S. PATENT DOCUMENTS 6,025,818 A * 2/2000 Okano ..... 345/63
6,351,253 B2 * 2/2002 Kasahara et al. ..... 345/63
6,489,938 B1 * 12/2002 Ito ..... 345/63
6,812,932 B2 * 11/2004 Kasahara et al. ..... 345/613
6,882,351 B2 * 4/2005 Morita ..... 345/690
7,102,599 B2 * 9/2006 Okuzawa et al. ..... 345/63
2003/0011626 A1 * 1/2003 Tanabe et al. ..... 345/690
2003/0146910 A1 8/2003 Tokunaga
2003/0214464 A1 * 11/2003 Lim et al. ..... 345/60

FOREIGN PATENT DOCUMENTS

| | | | |
|---|---|---|---|
| CN | 1327226 | | 12/2001 |
| EP | 1233395 | | 8/2002 |
| JP | 10-187093 | | 7/1998 |
| JP | 10197289 A | * | 7/1998 |
| JP | 2000066638 | | 3/2000 |
| JP | 2000242210 | | 9/2000 |
| JP | 2001042818 | | 2/2001 |
| JP | 2001282183 | | 10/2001 |
| JP | 2002-149109 | | 5/2002 |
| JP | 2002156942 | | 5/2002 |
| JP | 2002221934 | | 8/2002 |

(Continued)

*Primary Examiner*—Amr Awad
*Assistant Examiner*—Tony Davis
(74) *Attorney, Agent, or Firm*—H.C. Park & Associates, PLC

(57) ABSTRACT

In a plasma display, image data are mapped on N subfields, and the subfield with the greatest weight is determined from among the mapped subfields. When the subfield with the greatest weight is the $K^{th}$ subfield (K>M), grayscales of the image data are expressed with the mapped data of the $(K-M+1)^{th}$ subfield to the $K^{th}$ subfield, and the mapped data from the first subfield to the $(K-M)^{th}$ subfield may be ignored.

17 Claims, 5 Drawing Sheets

| Subfields | 1 | 2 | 3 | 4 | 5 | 6 | 7 | 8 | 9 | 10 | 11 | 12 | 13 | 14 | Gray scales |
|---|---|---|---|---|---|---|---|---|---|---|---|---|---|---|---|
| Brightness weights | 1 | 2 | 3 | 4 | 6 | 9 | 13 | 19 | 28 | 41 | 62 | 85 | 108 | 131 | 512 |
| 4 | 1 | 0 | 1 | 0 | 0 | 0 | 0 | 0 | 0 | 0 | 0 | 0 | 0 | 0 | 4 |
| 35 | 1 | 1 | 0 | 1 | 0 | 1 | 0 | 1 | 0 | 0 | 0 | 0 | 0 | 0 | 35 |
| 206 | 0 | 1 | 1 | 1 | 0 | 1 | 1 | 0 | 1 | 0 | 1 | 1 | 0 | 0 | 206 |
| 207 | 1 | 1 | 1 | 1 | 0 | 1 | 1 | 0 | 1 | 0 | 1 | 1 | 0 | 0 | 207 |
| | | | | | | | | | | | | | | | |
| 314 | 0 | 1 | 1 | 1 | 0 | 1 | 1 | 0 | 1 | 0 | 1 | 1 | 1 | 0 | 314 |
| 315 | 1 | 1 | 1 | 1 | 0 | 1 | 1 | 0 | 1 | 0 | 1 | 1 | 1 | 0 | 314 |
| | | | | | | | | | | | | | | | |
| 335 | 0 | 0 | 1 | 1 | 0 | 1 | 1 | 0 | 1 | 0 | 1 | 1 | 0 | 1 | 335 |
| 336 | 1 | 0 | 1 | 1 | 0 | 1 | 1 | 0 | 1 | 0 | 1 | 1 | 0 | 1 | 335 |
| 337 | 0 | 1 | 1 | 1 | 0 | 1 | 1 | 0 | 1 | 0 | 1 | 1 | 0 | 1 | 335 |
| 338 | 1 | 1 | 1 | 1 | 0 | 1 | 1 | 0 | 1 | 0 | 1 | 1 | 0 | 1 | 335 |

FOREIGN PATENT DOCUMENTS

| | | |
|---|---|---|
| JP | 2003140596 | 5/2003 |
| JP | 2003140597 | 5/2003 |
| JP | 2003173161 | 6/2003 |
| JP | 2003177696 | 6/2003 |
| KR | 1020000016955 | 3/2000 |
| KR | 1020010096310 | 11/2001 |
| KR | 1020010098797 | 11/2001 |
| KR | 1020020061907 | 7/2002 |

* cited by examiner

FIG.3

| Subfields | 1 | 2 | 3 | 4 | 5 | 6 | 7 | 8 | 9 | 10 | 11 | 12 | 13 | 14 | Gray scales |
|---|---|---|---|---|---|---|---|---|---|---|---|---|---|---|---|
| Brightness weights | 1 | 2 | 3 | 4 | 6 | 9 | 13 | 19 | 28 | 41 | 62 | 85 | 108 | 131 | 512 |
| 4 | 1 | 0 | 1 | 0 | 0 | 0 | 0 | 0 | 0 | 0 | 0 | 0 | 0 | 0 | 4 |
| 35 | 1 | 1 | 0 | 1 | 0 | 1 | 0 | 1 | 0 | 0 | 0 | 0 | 0 | 0 | 35 |
| 206 | 0 | 1 | 1 | 1 | 0 | 1 | 1 | 0 | 1 | 0 | 1 | 1 | 0 | 0 | 206 |
| 207 | 1 | 1 | 1 | 1 | 0 | 1 | 1 | 0 | 1 | 0 | 1 | 1 | 0 | 0 | 207 |
| | | | | | | | | | | | | | | | |
| 314 | 0 | 1 | 1 | 1 | 0 | 1 | 1 | 0 | 1 | 0 | 1 | 1 | 1 | 0 | 314 |
| 315 | 1 | 1 | 1 | 1 | 0 | 1 | 1 | 0 | 1 | 0 | 1 | 1 | 1 | 0 | 314 |
| | | | | | | | | | | | | | | | |
| 335 | 0 | 0 | 1 | 1 | 0 | 1 | 1 | 0 | 1 | 0 | 1 | 1 | 0 | 1 | 335 |
| 336 | 1 | 0 | 1 | 1 | 0 | 1 | 1 | 0 | 1 | 0 | 1 | 1 | 0 | 1 | 335 |
| 337 | 0 | 1 | 1 | 1 | 0 | 1 | 1 | 0 | 1 | 0 | 1 | 1 | 0 | 1 | 335 |
| 338 | 1 | 1 | 1 | 1 | 0 | 1 | 1 | 0 | 1 | 0 | 1 | 1 | 0 | 1 | 335 |

FIG.5

| | | Valid data of "just-before" discharge cell | |
|---|---|---|---|
| | | 0 | 1 |
| Valid data of "after" discharge cell | 0 | 0 | Maintain original data |
| | 1 | Maintain original data | 1 |

FIG.6

| | | First subfield data of "just-before" discharge cell | |
|---|---|---|---|
| | | 0 | 1 |
| Invalid data of first subfield of discharge cell to be processed | 0 | 0 | 0 |
| | 1 | 0 | 1 |

FIG.7

| | | First and second subfield data of "just-before" discharge cell | | | |
|---|---|---|---|---|---|
| | | 00 | 01 | 10 | 11 |
| Invalid data of first and second subfields of discharge cell to be processed | 00 | 00 | 00 | 00 | 00 |
| | 01 | 00 | 01 | 00 | 01 |
| | 10 | 00 | 00 | 10 | 10 |
| | 11 | 00 | 01 | 10 | 11 |

PLASMA DISPLAY AND DRIVING METHOD THEREOF

CROSS REFERENCE TO RELATED APPLICATIONS

This application claims priority to and the benefit of Korean Patent Application Nos. 10-2004-0063818, 10-2004-0063819, and 10-2004-0063820, filed on Aug. 13, 2004, which are hereby incorporated by reference for all purposes as if fully set forth herein.

BACKGROUND OF THE INVENTION

1. Field of the Invention

The present invention relates to a plasma display and a driving method thereof, and more particularly, to a method for expressing gray scales of a plasma display.

2. Discussion of the Background

Generally, in a plasma display, a field (1 TV field) is divided into a plurality of respectively weighted subfields. Gray scales may be expressed by summing weights of subfields selected to display an image from among the subfields.

However, expressing gray scales using subfields may cause contour noise. For example, when using subfields with weights set to $2^n$, contour noise may occur when a discharge cell expresses the grayscales of 127 and 128 in consecutive fields. Therefore, the number of subfields may be increased to reduce the weight of a higher weighted subfield.

Also, the number of subfields may be increased to improve gray scale expression. For example, fourteen subfields may be used to express 512 gray scales. However, each subfield may have an address period for selecting a discharge cell to emit light in the corresponding subfield. In the address period, many switching operations are performed to select discharge cells to emit light, thereby generating power consumption. Additionally, an address discharge is generated to select discharge cells, thereby increasing power consumption. Accordingly, increasing the number of subfields may increase the number of address periods, as well as power consumption in the address periods.

SUMMARY OF THE INVENTION

The present invention provides a plasma display driving method to reduce power consumption in an address period when utilizing an increased number of subfields.

Additional features of the invention will be set forth in the description which follows, and in part will be apparent from the description, or may be learned by practice of the invention.

The present invention discloses a PDP driving method in which a field is divided into N subfields (where N is a natural number) having brightness weights, and gray scales are expressed by a summation of weights of subfields from among the N subfields, wherein the PDP has a plurality of discharge cells. In the method, image data are mapped on the N subfields, M (a natural number less than N) subfields for expressing the image data are set from among the N subfields, and the image data are expressed by a summation of weights of the M subfields. All image data is expressed using no more than M subfields.

The present invention also discloses a PDP driving method in which a field is divided into N subfields having brightness weights, and gray scales are expressed by a summation of weights of subfields from among the N subfields, wherein the PDP has a plurality of discharge cells. In the driving method, image data are mapped on the N subfields, valid data corresponding to M subfields are set from among the N subfields in which the image data are mapped, and when a first discharge cell has invalid data, valid data of the first discharge cell are set according to data of at least one discharge cell that is provided at the same address line as that of the first discharge cell and is scanned at a time that is different from that of the first discharge cell. N and M are natural numbers, and M is less than N.

The present invention also discloses a plasma display comprising a PDP, a driver, and a controller. The PDP has a plurality of discharge cells. The driver applies a driving signal to the discharge cells. The controller controls the driver to divide a field into N subfields having brightness weights, and to express gray scales of image data with M subfields from among the N subfields. N and M are natural numbers, M is less than N, and all image data is expressed using no more than M subfields.

The present invention also discloses a plasma display comprising a PDP, a driver, and a controller. The PDP has a plurality of discharge cells. The driver applies a driving signal to the discharge cells. The controller controls the driver to divide a field into N subfields having brightness weights to map image data for the respective discharge cells on the N subfields, and to express gray scales using the mapped image data. The controller sets data of the first subfield to a $(K-M)^{th}$ subfield of the first discharge cell according to data of at least one discharge cell that is scanned at a time different from the time of the first discharge cell when the N subfields are arranged in an increasing order of brightness weights and the image data for first discharge cell uses a $K^{th}$ subfield, which is after a $M^{th}$ subfield.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 3 shows a subfield mapping table according to a first embodiment of the present invention.

FIG. 5 shows data determined by the method of FIG. 4.

FIG. 6 and FIG. 7 show an invalid data processing method according to a third embodiment of the present invention.

DETAILED DESCRIPTION OF THE ILLUSTRATED EMBODIMENTS

Figure 1:
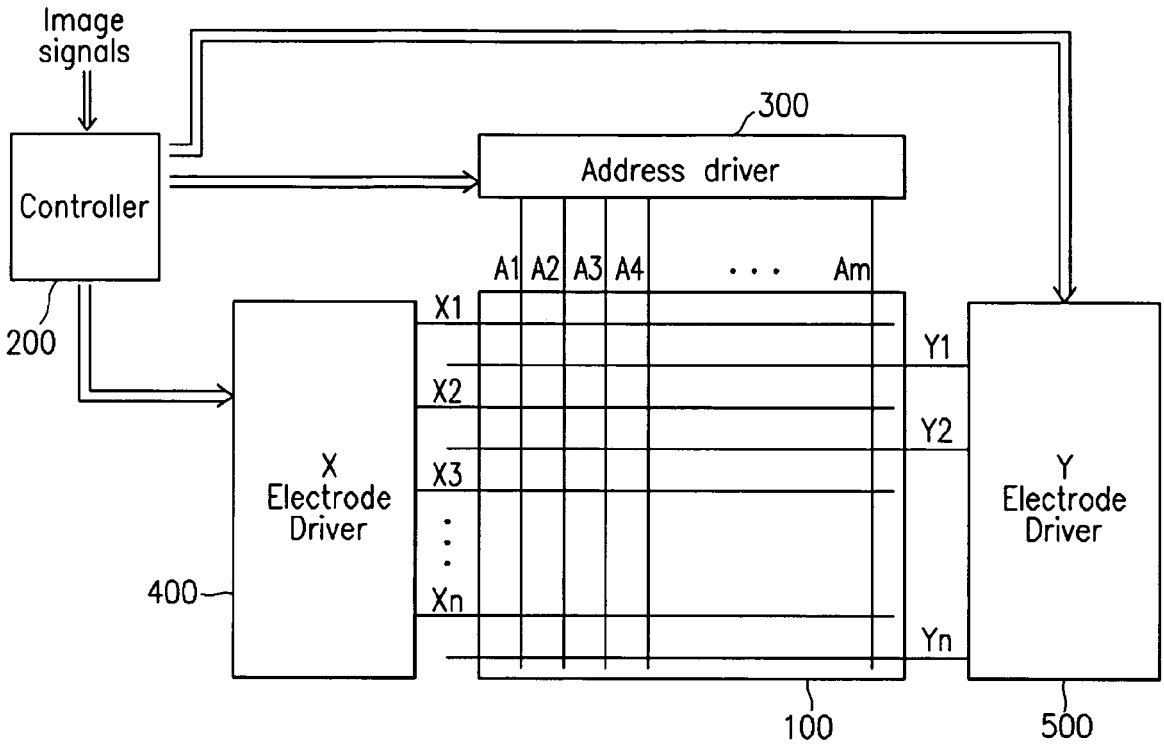
FIG. 1 shows a diagram for a plasma display according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

FIG. 1 shows a diagram for a plasma display according to an exemplary embodiment of the present invention.

As shown in FIG. 1, the plasma display may include a plasma display panel (PDP) 100, a controller 200, an address electrode driver 300, an X electrode driver 400, and a Y electrode driver 500.

The PDP 100 may include a plurality of address electrodes A1-Am extending in the column direction, and a plurality of sustain (X) electrodes X1-Xn and a plurality of scan (Y) electrodes Y1-Yn extending in pairs in the row direction. The X electrodes X1-Xn are arranged to correspond to the Y electrodes Y1-Yn. Here, discharge spaces provided at crossing regions of the address electrodes and the X and Y electrodes form discharge cells.

The controller 200 selects a subfield in which discharge cells are to be turned on from among the subfields, and outputs an address driving control signal, an X electrode driving control signal, and a Y electrode driving control signal. The address electrode driver 300, the X electrode driver 400, and the Y electrode driver 500 receive the corresponding driving control signal from the controller 200 and apply a driving voltage to the address electrodes A1-Am, the X electrodes X1-Xn, and the Y electrodes Y1-Yn, respectively, in each subfield.

Figure 2:
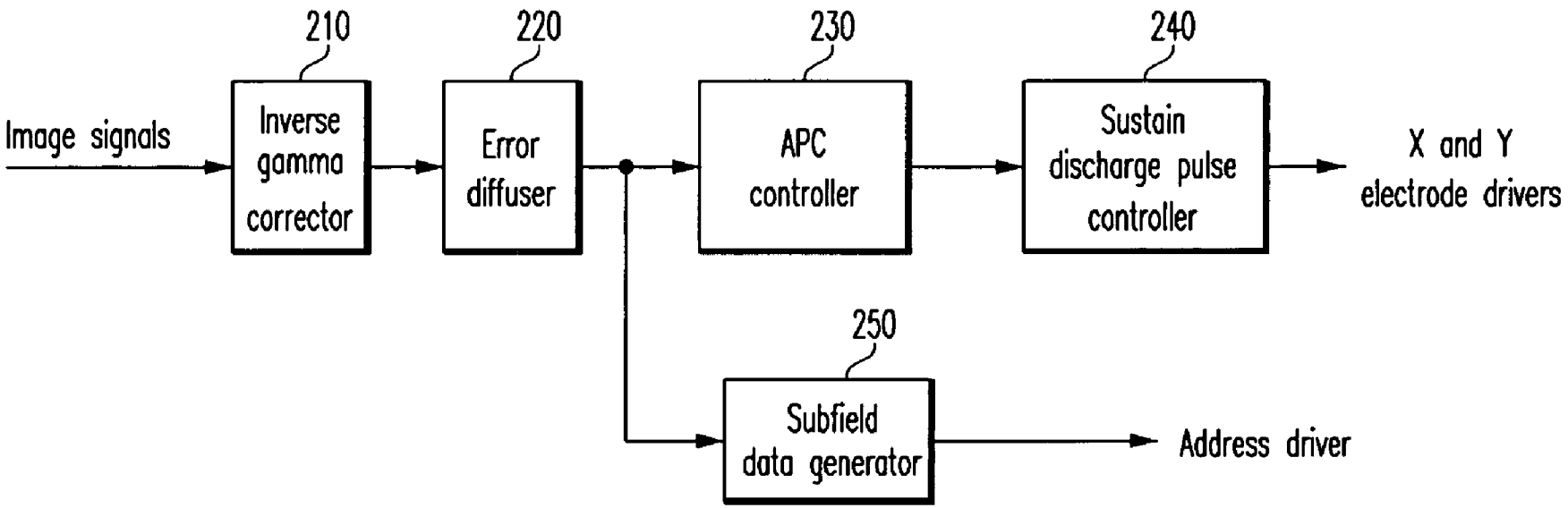
FIG. 2 shows a detailed block diagram of a controller in the plasma display of FIG. 1.

FIG. 2 shows a detailed block diagram of the controller 200 of FIG. 1. Referring to FIG. 2, the controller 200 may include an inverse gamma corrector 210, an error diffuser 220, an automatic power control (APC) controller 230, a sustain discharge pulse controller 240, and a subfield data generator 250.

The inverse gamma corrector 210 performs inverse gamma correction on an input video signal to generate image data. In detail, the inverse gamma corrector 210 may use a lookup table (not shown) storing data that corresponds to the inverse gamma characteristic curve to modify the grayscale of the input video signal. The error diffuser 220 diffuses a predetermined amount of bits of the inverse-gamma-corrected image data to adjacent pixels to improve expression of grayscales. The inverse gamma corrector 210 and the error diffuser 220 might not be used according to the plasma display characteristics.

The APC controller 230 detects a screen load ratio from the image data output by the error diffuser 220, and it calculates an APC level corresponding to the total number of sustain discharge pulses according to the screen load ratio. The APC level corresponds to the total number of sustain discharge pulses used in a sustain period of a field. For example, the APC controller 230 calculates a screen load ratio from an average signal level of image data corresponding to one field, and it reduces the total number of the sustain discharge pulses to control power consumption for a high screen load ratio. The sustain discharge pulse controller 240 controls the X electrode driver 400 and the Y electrode driver 500 to output sustain discharge pulses based on the APC level.

The subfield data generator 250 maps the image data output by the error diffuser 220 to a plurality of subfields to generate subfield data. The subfield data indicate light-mitting and non-light emitting discharge cells for each subfield. The subfield data generator 250 transmits the mapped subfield data to the address driver 300, which applies an address pulse to an address electrode to select light emitting discharge cells for each subfield according to subfield data. Here, according to the grayscales of the input image data, the subfield data generator 250 determines M subfields to be used, from among a total of N subfields, to express grayscales, where (M<N).

An operation of the controller 200 and an operation of the subfield data generator 250, in particular, will be described below. As used herein, "valid data" denotes data corresponding to M subfields used to express grayscales from among the N subfields, and "invalid data" denotes data corresponding to subfields that are not part of the M subfields from among the N subfields and that have weights that are lower than those of the M subfields.

FIG. 3 shows a subfield mapping table according to a first exemplary embodiment of the present invention.

It is assumed in FIG. 3 for ease of description that one field has fourteen subfields (SF1-SF14) for expressing 512 gray scale levels, and brightness weights of the first through fourteenth subfields (SF1-SF14) are given as 1, 2, 3, 4, 6, 9, 13, 19, 28, 41, 62, 85, 108, and 131, respectively. It is also assumed that the fourteen weights are arranged in increasing order, and the weight of the first subfield SF1 is given as 1 and the weight of the fourteenth subfield SF14 is given as 131. The data of "00110110101101" may be mapped to the fourteen subfields (SF1-SF14) when expressing the grayscale of 335. Here, '0' represents that the discharge cell does not emit light in the corresponding subfield, and '1' represents that the discharge cell emits light in the corresponding subfield.

The subfield data generator 250 maps the grayscales of input image data on fourteen subfields, and determines the subfield having the greatest weight from among the fourteen subfields (i.e. the highest weighted subfield in which the discharge cell emits light from among the fourteen subfields). Referring to FIG. 3, for example, the third subfield has the greatest weight for the input grayscale of 4, the eighth subfield has the greatest weight for the input grayscale of 35, and the twelfth subfield has the greatest weight for the input grayscales of 206 and 207. Accordingly, when the subfield with the greatest weight is one of the first through twelfth subfields, the thirteenth and fourteenth subfields SF13 and SF14 are not used, and the input grayscale may be expressed using the first to twelfth subfields SF1-SF12.

Additionally, the thirteenth subfield SF13 has the greatest weight for the input grayscales of 314 and 315, for example. Hence, when the thirteenth subfield SF13 has the greatest weight, the subfield data generator 250 ignores the data corresponding to the first subfield SF1. That is, the input grayscales of 314 and 315 are expressed in the grayscale of 314 using the second to thirteenth subfields (SF2-SF13).

Further, the fourteenth subfield SF14 has the greatest weight for the input grayscales of 335, 336, 337, and 338, for example. Hence, when the fourteenth subfield SF14 has the greatest weight, the subfield data generator 250 ignores the data corresponding to the first and second subfields SF1 and SF2. That is, the input grayscales of 335, 336, 337, and 338 are expressed in the grayscale of 335 using the third to fourteenth subfields (SF3-SF14).

In summary, in the first exemplary embodiment of the present invention, the input image data are expressed by M subfields from among a total of N subfields (M<N). In this case, the data corresponding to the first to $(K-M)^{th}$ subfields, where K>M, may be ignored and invalidated when the input image data are expressed using the subfields up to the $K^{th}$ subfield in the order of brightness weights. Accordingly, the image data may be expressed with M subfields, which reduces the number of address periods compared to the case of using N subfields to express grayscales, thereby reducing power consumption in the address period.

When the image data is expressed using up to the $K^{th}$ subfield, the data corresponding to the first to $(K-M)^{th}$ subfields are invalidated, but the grayscale is not substantially affected when ignoring the data with low weights because expressing image data using up to the $K^{th}$ subfield represents the case of expressing a relatively high grayscale. Therefore, according to the first exemplary embodiment of the present invention, the increased number of subfields for expression of grayscales or reduction of contour noise allows mapping and using some subfields, thus preventing an increase of power consumption caused by an increased number of address periods.

As described above, subfields with low weights may be ignored. In other words, '0's' may be allocated to the corresponding subfields when the subfields with high weights are used in the first exemplary embodiment of the present invention. However, assuming that the first subfield data of a discharge cell provided on the first row and the first column is a valid data of '1', and the first subfield data of a discharge cell provided on the second row and the first column is invalid data of '0', a switching operation is performed to apply an address voltage to the discharge cell of the first row and the first column, and another switching operation is performed to apply a non-address voltage to the discharge cell of the second row and the first column in the address period of the first subfield. Hence, the invalid data may generate switching, and power loss may occur because of switching.

A method for reducing power loss caused by invalid data will be described with reference to FIG. 4, FIG. 5, FIG. 6 and FIG. 7.

Figure 4:
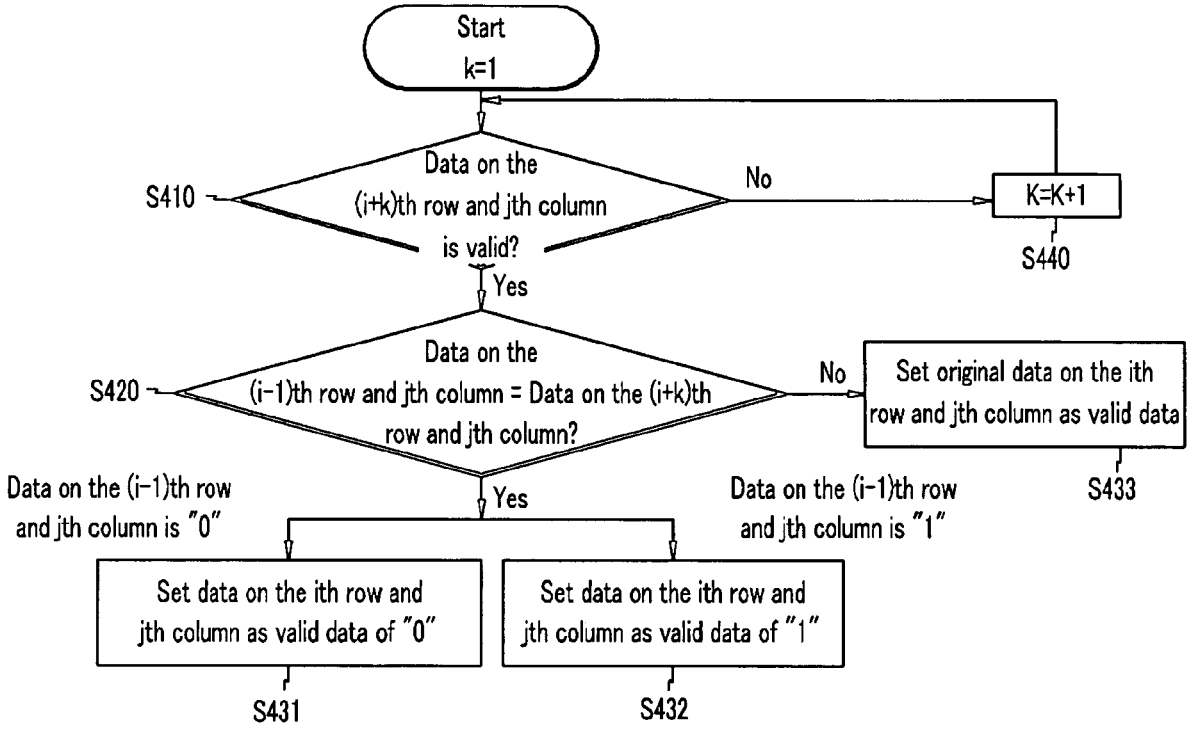
FIG. 4 shows a flowchart for an invalid data processing method according to a second embodiment of the present invention.

FIG. 4 shows a flowchart for an invalid data processing method according to a second exemplary embodiment of the present invention, and FIG. 5 shows valid data determined by the method of FIG. 4 on the assumption that the scan operation is sequentially performed in the column direction. Referring to FIG. 4 and FIG. 5, a method for processing invalid data of the first subfield of the discharge cell on the $i^{th}$ row and the $j^{th}$ column (i.e., the discharge cell formed by the $i^{th}$ Y electrode Yi and the $j^{th}$ address electrode Aj) will be described. Terms of "just before" and "just after" represent just before and just after in a temporal manner, and terms "before" and "after" include "just before" and "just after" and represent a temporal former stage and a temporal later stage, respectively.

As shown in FIG. 4, to process invalid data of the first subfield of the discharge cell on the $i^{th}$ row and the $j^{th}$ column, in step S410, the subfield data generator 250 determines whether the data of the first subfield of the discharge cell on the $(i+1)^{th}$ row and the $j^{th}$ column (just-after discharge cell) scanned just after the discharge cell on the $i^{th}$ row and the $j^{th}$ column is valid data.

When the data of the first subfield of the just-after discharge cell is valid, in step S420, the subfield data generator 250 compares the data of the first subfield of the discharge cell on the $(i-1)^{th}$ row and the $j^{th}$ column (just-before discharge cell) scanned just before the discharge cell on the $i^{th}$ row and the $j^{th}$ column with the data of the first subfield of the just-after discharge cell. When the data of the first subfield of the just-before discharge cell corresponds to the data of the first subfield of the just-after discharge cell, the subfield data generator 250 sets the data of the first subfield of the discharge cell on the $i^{th}$ row and the $j^{th}$ column to be the same as that of the just-before and just-after discharge cells. That is, as shown in FIG. 5, in step S431, the invalid data of the first subfield of the discharge cell on the $i^{th}$ row and the $j^{th}$ column is set to be valid data of '0' when the data of the first subfield of the just-before discharge cell and the data of the first subfield of the just-after discharge cell are given to be '0'; and in step S432, the invalid data of the first subfield of the discharge cell on the $i^{th}$ row and the $j^{th}$ column is set to be valid data of '1' when the data of the first subfield of the just-before discharge cell and the data of the first subfield of the just-after discharge cell are given to be '1.' Hence, since the just-before and just-after discharge cells correspond to the address data (subfield data) of the first subfield of the discharge cell on the $i^{th}$ row and the $j^{th}$ column, switching is not generated, and power loss caused by switching may be eliminated.

As shown in FIG. 5, in step S433, when the data of the first subfield of the just-before discharge cell does not correspond to the data of the first subfield of the just-after discharge cell, the subfield data generator 250 expresses the original invalid data of the first subfield of the discharge cell on the $i^{th}$ row and the $j^{th}$ column as valid data. In this instance, switching is not generated when expressing the invalid data with the original data since switching is generated between two adjacent valid data. That is, the original data may be expressed without switching loss.

When the data of the first subfield of the just-after discharge cell is not valid, in steps S440 and S410, the subfield data generator 250 sequentially determines whether the data of the first subfield of a discharge cell (an after discharge cell) scanned after the discharge cell on the $(i+1)^{th}$ row and the $i^{th}$ column is valid Hence, the subfield data generator 250 determines whether the data of the first subfield of the after discharge cell on the $(i+2)^{th}$ row and the $j^{th}$ column is valid. If not, the subfield data generator 250 determines whether the data of the first subfield of the after discharge cell on the $(i+3)^{th}$ row and the $j^{th}$ column is valid. This process may be repeated until finding an after discharge cell having valid data. When the data of the first subfield of the after discharge cell on the $(i+k)^{th}$ row and the $j^{th}$ column is found to be valid through the processes of S440 and S410, in step S420, the subfield data generator 250 compares the data of the first subfield of the just-before discharge cell with the data of the first subfield of the after discharge cell on the $(i+k)^{th}$ row and the $j^{th}$ column, and then sets the valid data of the first subfield of the discharge cell on the $i^{th}$ row and the $j^{th}$ column according to comparison results through the above-described processes of S431, S432, and S433.

The method for processing invalid data of the first subfield of the discharge cell on the $i^{th}$ row and the $j^{th}$ column has been described with reference to FIG. 4, and invalid data of the first and second subfields of the discharge cell on the $i^{th}$ row and the $j^{th}$ column can also be processed according to the method described with reference to FIG. 4.

The image data are mapped on the subfields, and invalid data is sequentially compared to the data of the just-before and just-after discharge cells to thereby set valid data according to the method described with reference to FIG. 4 and FIG. 5. In summary, when first to $K^{th}$ subfields are used to map image data corresponding to a discharge cell, the first to $(K-M)^{th}$ subfield data are processed as invalid data. In this case, the respective invalid data in the first to $(K-M)^{th}$ subfield data are determined by corresponding subfield data of a discharge cell having the initial valid data from among the just-before discharge cell and the just-after discharge cell. Consequently, according to the second exemplary embodiment of the present invention, invalid data is not ignored but compared with data of just-before and just-after discharge cells to reduce power consumption.

FIG. 6 and FIG. 7 respectively show an invalid data processing method according to a third exemplary embodiment of the present invention on the assumption that the scan operation is sequentially performed in the column direction. A method for processing invalid data of the first subfield of the discharge cell on the $i^{th}$ row and the $j^{th}$ column will be described with reference to FIG. 6.

The subfield data generator 250 maintains invalid data of the discharge cell on the $i^{th}$ row and the $j^{th}$ column at '0' as valid data of '0' when the data of the first subfield of the just-before discharge cell is given as '0'. No switching occurs due to the invalid data since the just-before discharge cell corresponds to the address data (subfield data) of the first subfield of the discharge cell on the $i^{th}$ row and the $j^{th}$ column, and no address discharge occurs since the address data is given as '0'.

The subfield data generator 250 maintains invalid data of the discharge cell on the $i^{th}$ row and the $j^{th}$ column at '1' as valid data of '1' when the data of the first subfield of the just-before discharge cell is given as '1'. The original data may be expressed as given, and power loss caused by switching does not occur.

The subfield data generator 250 processes invalid data of the discharge cell on the $i^{th}$ row and the $j^{th}$ column at 1 to be valid data of '0' when the data of the first subfield of the just-before discharge cell is given as '0'. Power loss caused by switching and address discharge may then be eliminated.

The subfield data generator 250 maintains invalid data of the discharge cell on the $i^{th}$ row and the $j^{th}$ column at '0' as valid data of '0' when the data of the first subfield of the just-before discharge cell is given as '1'. In this case, power loss caused by switching occurs, but power loss caused by address discharge may be eliminated since no address discharge is provided. In like manner, image data are mapped on subfields, and invalid data is sequentially compared to the data of the just-before discharge cell.

Referring to FIG. 7, a method for processing invalid data of first and second subfields of the discharge cell on the $i^{th}$ row and the $j^{th}$ column will be described.

That is, the method given with reference to FIG. 6 will be applied to the first and second subfields. For example, invalid data is set to be '00' as described with reference to FIG. 6 when the data of first and second subfields of the just-before discharge cell are given as '01' and the data of first and second subfields of the discharge cell to be processed as invalid data are given as '00.' The invalid data is set to be '10' when the data of first and second subfields of the just-before discharge cell are given as '11' and the data of first and second subfields of the discharge cell to be processed as invalid data are given as '10.'

According to the third exemplary embodiment of the present invention, the invalid data are not ignored, but are compared to the data of the just-before discharge cell to reduce power consumption.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving method of a plasma display in which a field is divided into N subfields having brightness weights, and gray scales are expressed by a summation of weights of subfields from among the N subfields, wherein the plasma display includes a plurality of discharge cells, the method comprising:

mapping image data on the N subfields;

setting valid data corresponding to M subfields from among the N subfields; and when a first discharge cell has invalid data, setting valid data of the first discharge cell according to data of at least one discharge cell that is provided at the same address line as that of the first discharge cell and is scanned at a time that is different from that of the first discharge cell, the at least one discharge cell being a different discharge cell than the first discharge cell, wherein N and M are natural numbers greater than zero, and M is less than N, and wherein the valid data of the first discharge cell is set according to data of a second discharge cell that is scanned temporally before the first discharge cell and data of a third discharge cell that is scanned temporally after the first discharge cell.

2. The method of claim 1, wherein when the N subfields are arranged in an increasing order of brightness weights and a subfield with the greatest weight from among subfields used to express the image data is a $K^{th}$ subfield, image data mapped on a $(K-M+1)^{th}$ subfield to a $K^{th}$ subfield are set to be valid data, and image data mapped on the first subfield to a $(K-M)^{th}$ subfield are set to be invalid data, and wherein K is a natural number and is greater than M.

3. The method of claim 2, wherein valid data of an $i^{th}$ subfield from among the first subfield to the $(K-M)^{th}$ subfield of the first discharge cell is set according to valid data of the $i^{th}$ subfield the second discharge cell and valid data of the $i^{th}$ subfield of the third discharge cell, wherein i is an integer equaling 1 to (K−M).

4. The method of claim 3, wherein the second discharge cell is scanned just before the first discharge cell, and wherein the third discharge cell is an initial discharge cell of discharge cells scanned after the first discharge cell that has valid data that corresponds to the invalid data of the $i^{th}$ subfield of the first discharge cell.

5. The method of claim 4, wherein the valid data of the $i^{th}$ subfield of the first discharge cell are set to correspond to the valid data of the $i^{th}$ subfield of the second discharge cell and the valid data of the $i^{th}$ subfield of third discharge cell when the valid data of the $i^{th}$ subfield of the second discharge cell corresponds to the valid data of the $i^{th}$ subfield of the third discharge cell, and wherein the valid data of the $i^{th}$ subfield of the first discharge cell are set to correspond to the invalid data of the $i^{th}$ subfield of the first discharge cell when the valid data of the i.sup.$^{th}$ subfield of the second discharge cell do not correspond to the valid data of the $i^{th}$ subfield of the third discharge cell.

6. The method of claim 1, wherein the valid data of the first discharge cell are set according to data of a second discharge cell scanned temporally just before the first discharge cell.

7. The method of claim 6, wherein when the N subfields are arranged in an increasing order of brightness weights and a subfield with the greatest weight from among subfields used to express the image data is a $K^{th}$ subfield, image data mapped on a $(K-M+1)^{th}$ subfield to a $K^{th}$ subfield are set to be valid data, and image data mapped on the first subfield to a $(K-M)^{th}$ subfield are set to be invalid data, and wherein K is a natural number and is greater than M.

8. The method of claim 7, wherein valid data of the first subfield to the $(K-M)^{th}$ subfield of the first discharge cell are set according to data of the first subfield to the $(K-M)^{th}$ subfield of the second discharge cell, respectively.

9. The method of claim 8, wherein valid data of an $i^{th}$ subfield of the first discharge cell is set to be '0' when data of the $i^{th}$ subfield of the second discharge cell is given to be '0', wherein the valid data of the $i^{th}$ subfield of the first discharge cell is set to correspond to the invalid data of the $i^{th}$ subfield of the first discharge cell when the data of the $i^{th}$ subfield of the second discharge cell is given to be '1', and wherein i is an integer equaling 1 to (K−M).

10. The method of claim 1, wherein when the N subfields are arranged in an increasing order of brightness weights and a subfield with the greatest weight from among subfields used to express the image data is a $L^{th}$ subfield, data from the first subfield to a $M^{th}$ subfield are set to be valid data, and the image data are expressed using the valid data, and wherein L is a natural number and is less than M.

11. A plasma display, comprising:

a plasma display panel comprising a plurality of discharge cells;

a driver to apply a driving signal to the discharge cells; and a controller to control the driver to divide a field into N subfields having brightness weights to map image data for the respective discharge cells on the N subfields, and to express gray scales using the mapped image data, wherein the controller sets data of the first subfield to a $(K-M)^{th}$ subfield of the first discharge cell according to data of at least one discharge cell that is scanned at a time different from the time of the first discharge cell when the N subfields are arranged in an increasing order of brightness weights and the image data for first discharge cell uses a $K^{th}$ subfield, which is after a $M^{th}$ subfield, the at least one discharge cell being a different discharge cell than the first discharge cell, and wherein the controller sets data of the first subfield to the $(K-M)^{th}$ subfield of the first discharge cell according to a second discharge cell scanned temporally before the first discharge cell and a third discharge cell scanned temporally after the first discharge cell.

12. The plasma display of claim 11, wherein the second discharge cell is scanned just before the first discharge cell and is provided on the same column as that of the first discharge cell when the discharge cells are scanned in a row direction, and the third discharge cell is an initial discharge cell that uses subfields before a $(i+M)^{th}$ subfield from among the discharge cells scanned after the first discharge cell.

13. The plasma display of claim 12, wherein the controller sets data of an $i^{th}$ subfield of the first discharge cell to correspond to data of the $i^{th}$ subfield of the second discharge cell and data of the $i^{th}$ subfield of the third discharge cell when the data of the $i^{th}$ subfield of the second discharge cell corresponds to the data of the $i^{th}$ subfield of the third discharge cell.

14. The plasma display of claim 12, wherein the controller maintains data of an $i^{th}$ subfield of the first discharge cell when data of the $i^{th}$ subfield of the second discharge cell do not correspond to the data of the $i^{th}$ subfield of the third discharge cell.

15. The plasma display of claim 11, wherein the at least one discharge cell is scanned just before the first discharge cell and is provided on the same column as that of the first discharge cell when the discharge cells are scanned in a row direction.

16. The plasma display of claim 15, wherein the controller sets the first discharge cell not to emit light in an $i^{th}$ subfield when the at least one discharge cell does not emit light in the $i^{th}$ subfield, and wherein i is an integer equal to 1 to (K−M).

17. The plasma display of claim 15, wherein the controller maintains the data of an $i^{th}$ subfield of the first discharge cell as originally mapped data when the at least one discharge cell emits light in the $i^{th}$ subfield, and wherein i is an integer equal to 1 to (K−M).

* * * * *